US006287420B1

(12) United States Patent
Graf

(10) Patent No.: US 6,287,420 B1
(45) Date of Patent: Sep. 11, 2001

(54) MULTI-PLY FIBER WEB FORMING METHOD AND APPARATUS

(75) Inventor: Edwin X. Graf, Menasha, WI (US)

(73) Assignee: Voith Sulzer Paper Technology North America, Inc., Appleton, WI (US)

( * ) Notice: Subject to any disclaimer, the term of this patent is extended or adjusted under 35 U.S.C. 154(b) by 0 days.

(21) Appl. No.: 09/543,217

(22) Filed: Apr. 5, 2000

(51) Int. Cl.[7] ..... D21F 11/04
(52) U.S. Cl. ..... 162/133; 162/304; 162/306
(58) Field of Search ..... 162/123, 132, 162/133, 304, 306

(56) References Cited

U.S. PATENT DOCUMENTS 3,625,814 * 12/1971 DeNoyer ..... 162/304
4,154,645 * 5/1979 Kankaanpaa ..... 162/304

* cited by examiner

*Primary Examiner*—Karen M. Hastings
(74) *Attorney, Agent, or Firm*—Taylor & Aust, P.C.

(57) ABSTRACT

A multi-ply fiber web forming apparatus includes a lower forming fabric defining a lower forming fabric run. A first headbox is positioned above the lower forming fabric for discharging a fiber suspension onto the lower forming fabric. An upper forming fabric defines an upper forming fabric run. A second headbox is positioned above the upper forming fabric for discharging a fiber suspension onto the upper forming fabric. A wet forming box is positioned below the lower forming fabric for applying a liquid to the lower forming fabric. A transfer roll is positioned above the upper forming fabric. The transfer roll and the wet forming box are positioned in close opposing relationship to each other, whereby each of the lower forming fabric and the upper forming fabric pass therebetween in a transfer area.

26 Claims, 2 Drawing Sheets

MULTI-PLY FIBER WEB FORMING METHOD AND APPARATUS

BACKGROUND OF THE INVENTION

1. Field of the invention.

The present invention relates to an apparatus for forming a fiber web, and, more particularly, to an apparatus for forming a multi-ply fiber web.

2. Description of the related art.

A paper-making machine is used for forming a fiber web, such as a paper web, from a prepared fiber suspension, such as a wood fiber suspension. The fiber suspension is discharged onto a traveling forming fabric, such as a wire, with a predetermined cross-sectional profile and is formed within the paper-making machine to produce the fiber web. Typically, the fiber suspension is discharged onto the forming fabric at a single location to form a single ply fiber web. However, it is also known to form a multi-ply fiber web in a paper-making machine. With a multi-ply machine, the fiber suspension is discharged onto the same or another forming fabric at a different location in the paper-making machine. The two plies are joined together to form the multi-ply fiber web. Typically, starch or another bonding agent is applied to one or both plies to join the two plies together.

Although a multi-ply paper-making machine as described above is effective to produce a high quality fiber web, the additional processing which is required to apply the starch or other bonding agent to one or both plies of the fiber web requires additional equipment, space and material cost.

What is needed in the art is an apparatus and method for manufacturing multi-ply fiber webs which does not require the application of additional bonding agents to the multiple plies in the fiber web.

SUMMARY OF THE INVENTION

The present invention provides a multi-ply fiber web forming apparatus which joins the multiple plies in a transfer area utilizing water under pressure which wets the plies.

The invention comprises, in one form thereof, a multi-ply fiber web forming apparatus including a lower forming fabric defining a lower forming fabric run. A first headbox is positioned above the lower forming fabric for discharging a fiber suspension onto the lower forming fabric. An upper forming fabric defines an upper forming fabric run. A second headbox is positioned above the upper forming fabric for discharging a fiber suspension onto the upper forming fabric. A wet forming box is positioned below the lower forming fabric for applying a liquid to the lower forming fabric. A transfer roll is positioned above the upper forming fabric. The transfer roll and the wet forming box are positioned in close opposing relationship to each other, whereby each of the lower forming fabric and the upper forming fabric pass therebetween in a transfer area.

An advantage of the present invention is that the multiple plies may be joined together using only water, without the use of starch or other bonding agents.

Another advantage is that the extent to which the multiple plies are wetted can be easily varied by controlling the flow rate and/or pressure of the water which is transported into the transfer area.

Yet another advantage is that a vacuum may be drawn on the transfer roll to further assist in wetting the multiple plies of the fiber web.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
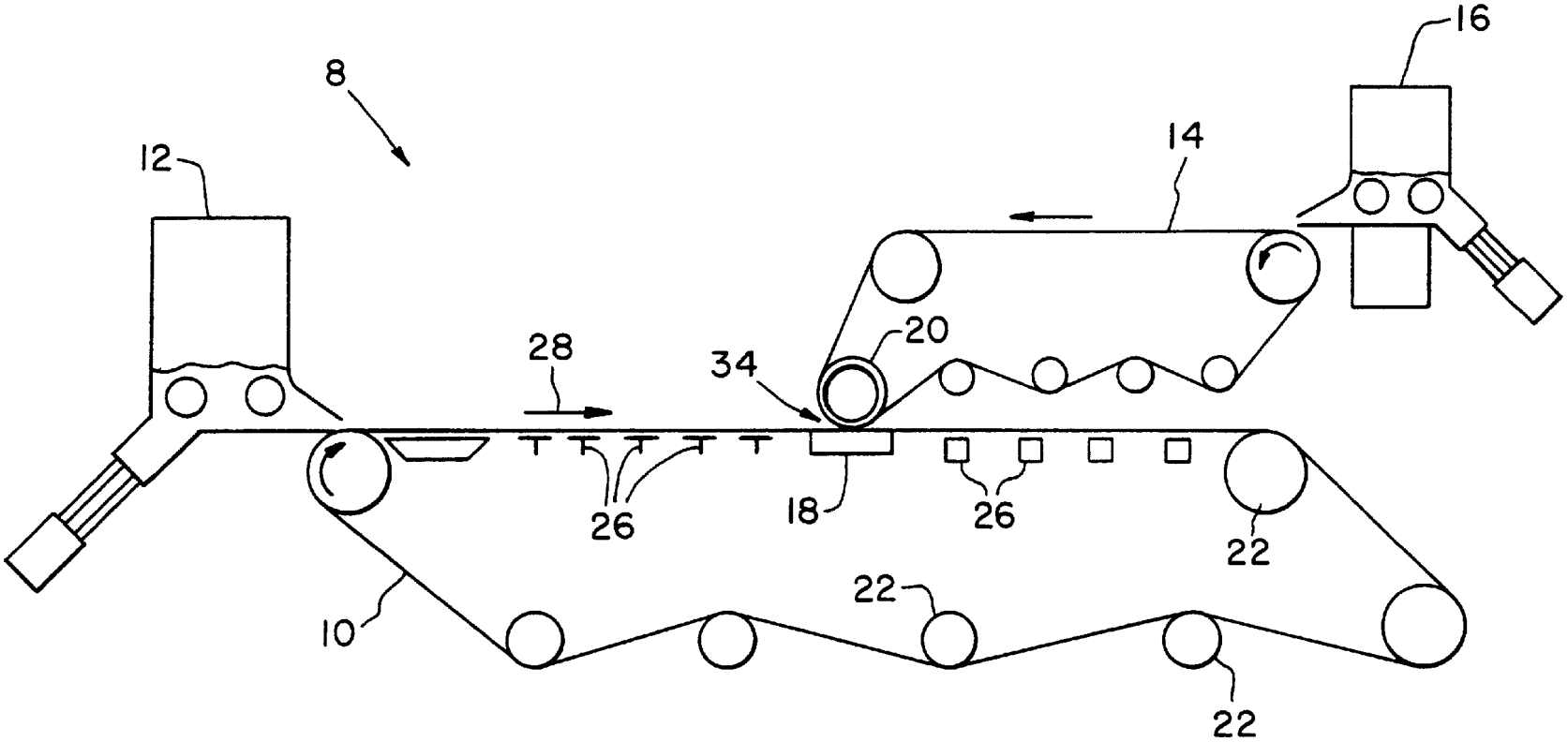
FIG. 1 is a schematic illustration of a multi-ply fiber web forming apparatus of the present invention.

Referring now to the drawings, and more particularly to FIG. 1, there is shown an embodiment of a multi-ply fiber web forming apparatus 8 of the present invention, which generally includes a lower forming fabric 10, a first headbox 12, an upper forming fabric 14, a second headbox 16, a wet forming box 18 and a transfer roll 20.

Lower forming fabric 10 is carried by plurality of rolls 22, and defines a continuous lower forming fabric run. Lower forming fabric 10 preferably is in the form of a wire, but may also be formed as a felt, drilled fabric, etc., depending upon the specific application. A plurality of foils 24 and/or vacuum boxes 26 may be positioned under a top run of lower forming fabric 10 to remove water from the fiber suspension carried thereby.

First headbox 12 is positioned at an upstream end of the top run of lower forming fabric 10, relative to travel direction 28. First headbox 12 may be of conventional design, and thus is not described in detail. For example, first headbox 12 may be in the form of a hydraulic or "VALLEY" headbox marketed by the assignee of the present invention. First headbox 12 is thus positioned at least partially above the top run of lower forming fabric 10 and discharges a fiber suspension onto lower forming fabric 10 to form a first fiber ply.

Upper forming fabric 14 is carried by a plurality of rolls 30 and defines a continuous upper forming fabric run. Upper forming fabric 14 preferably is in the form of a wire, but may be configured as a felt, drilled forming fabric, etc., depending upon the particular application. Second headbox 16 is positioned at an upstream end of a top run of upper forming fabric 14, relative to a travel direction 32. Second headbox 16 may be of conventional design, and discharges a fiber suspension onto upper forming fabric 14 for forming a second fiber ply carried by upper forming fabric 14. Second headbox 16 may be, e.g., a hydraulic or "VALLEY" headbox marketed by the assignee of the present invention.

Figure 2:
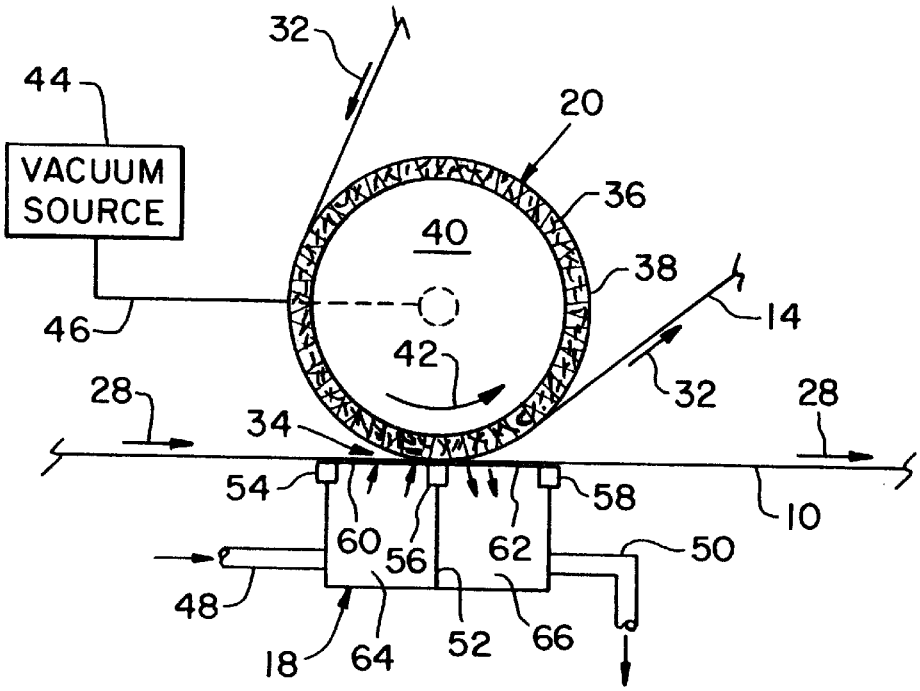
FIG. 2 is a fragmentary, sectional view of the transfer roll and wet forming box shown in FIG. 1.
Figure 3:
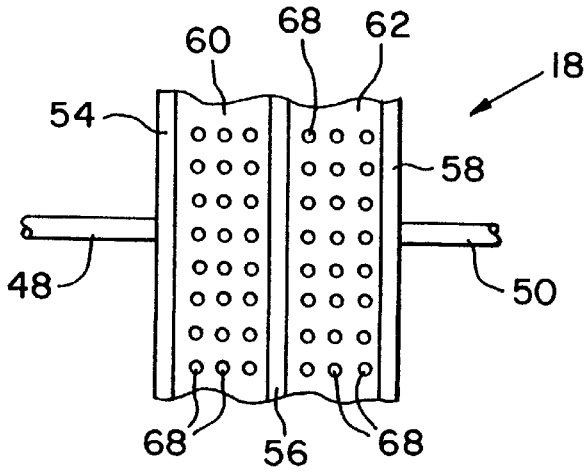
FIG. 3 is a fragmentary, top view of the wet forming box shown in FIGS. 1 and 2.

Referring now to FIGS. 2 and 3, wet forming box IS and transfer roll 20 will be described in greater detail. As shown in FIG. 2, wet forming box 18 is positioned below and carries a portion of the top run of lower forming fabric 10. Transfer roll 20 carries upper forming fabric 14 and is positioned in close opposing relationship relative to wet forming box 18. Wet forming box 18 and transfer roll 20 thus cause lower forming fabric 10 and upper forming fabric 14 to pass therebetween in a transfer area 34. Within transfer area 34, the second fiber ply carried by upper forming fabric 14 is transferred to the top of the first fiber ply carried by lower forming fabric 10 to form a two-ply fiber web which is then carried away from transfer area 34 on lower forming fabric 10.

Transfer roll 20 has a shell 36 with a honeycomb structure defining a plurality of openings (not numbered) at the periphery thereof. A forming fabric such as a wire 38 is wrapped around and carried by shell 36. The porous configuration of both wire 38 and shell 36 allow water to be drawn into an interior 40 of transfer roll 20. Transfer roll 20 rotates in the same direction as travel direction 28 of lower forming fabric 10 within transfer area 34, as indicated by rotational arrow 42. To assist in removal of water within transfer area 34, a vacuum source 44 may be fluidly coupled with interior 40 of transfer roll 20, such as by fluid conduit 46.

Wet forming box 18 includes an inlet 48, an outlet 50, a weir 52, a plurality of seals 54, 56, 58, and a plurality of plates 60, 62. Weir 52 is positioned between inlet 48 and outlet 50 and extends to lower forming fabric 10. Weir 52 includes seal 56 at the distal end thereof. A first chamber 64 is disposed on a side of weir 52 adjacent inlet 48, and a second chamber 66 is disposed on a side of weir 52 adjacent outlet 50.

Seals 54, 56 and 58 each carry lower forming fabric 10 and function to at least partially define a fluid barrier between lower forming fabric 10 and the corresponding chamber 64 or 66.

Plate 60 extends between seals 54 and 56, and plate 62 extends between seals 56 and 58. Plates 60, 62 include a plurality of openings 68 therein which allow a liquid, preferably water, to pass therethrough into transfer area 34.

During use, a fiber suspension is discharged from first headbox 12 onto lower forming fabric 10 to form a first fiber ply carried by a top run of lower forming fabric 10. Second headbox 16 discharges a fiber suspension onto the top run of upper forming fabric 14 to form a second fiber ply which is carried by upper forming fabric 14. The first fiber ply carried by lower forming fabric 10 and the second fiber ply carried by upper forming fabric 14 are urged together within transfer area 34. Water flows from inlet 48 and into first chamber 64 of wet forming box 18. The pressurized water within first chamber 64 flows through opening 68 within plate 60 and impinges against lower forming fabric 10. The water travels through lower forming fabric 10 and at least wets the first fiber ply carried by lower forming fabric 10 within transfer area 34. Depending upon the pressure and flow rate of the water exiting openings 68 of plate 60, the second fiber ply may also be wetted within transfer area 34. The water is carried over seal 56 at the top of weir 52 within transfer area 34, and then flows through opening 68 in plate 62 to enter second chamber 66. A vacuum may be preferably drawn on second chamber 66 to assist in water removal from the multi-ply fiber web which exits from transfer area 34. To better wet the top or second fiber ply within transfer area 34, a vacuum is also drawn on interior 40 of transfer roll 20 using vacuum source 44. The vacuum within transfer roll 20 draws or pulls water into and/or through the top or second fiber ply within transfer area 34.

Wet forming box 18 and transfer roll 20 allow a multi-ply fiber web to be formed with the plies being bonded together without the use of starch or other bonding agents. The amount of wetting may be controlled by varying the flow rate and/or pressure of the water which flows over weir 52 against the first and second fiber plies within transfer area 34. The present invention therefore provides a simple and economical apparatus for joining plies in a multi-ply fiber web.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A multi-ply fiber web forming apparatus, comprising:

a lower forming fabric defining a lower forming fabric run;

a first headbox positioned above said lower forming fabric for discharging a fiber suspension onto said lower forming fabric to form a first fabric ply;

an upper forming fabric defining an upper forming fabric run;

a second headbox positioned above said upper forming fabric for discharging a fiber suspension onto said upper forming fabric to form a second fabric ply;

a wet forming box positioned below said lower forming fabric structured for applying a pressurized liquid to said lower forming fabric to wet at least said first fiber ply in a transfer area; and a transfer roll positioned above said upper forming fabric, said transfer roll and said wet forming box positioned in close opposing relationship to each other whereby each of said lower forming fabric and said upper forming fabric pass therebetween in said transfer area.

2. The multi-ply fiber web forming apparatus of claim 1, said wet forming box including an inlet, an outlet, a weir between said inlet and said outlet, a first chamber on a side of said weir adjacent said inlet, and a second chamber on a side of said weir adjacent said outlet.

3. The multi-ply fiber web forming apparatus of claim 2, said weir extending to said lower forming fabric.

4. The multi-ply fiber web forming apparatus of claim 3, said weir including a seal positioned at an end of said weir adjacent said lower forming fabric.

5. The multi-ply fiber web forming apparatus of claim 2, said weir including at least one plate positioned adjacent said lower forming fabric, said plate including a plurality of openings therein for allowing the liquid to pass through said plate.

6. The multi-ply fiber web forming apparatus of claim 1, said transfer roll including a shell with a plurality of openings and a forming fabric wrapped around said shell.

7. The multi-ply fiber web forming apparatus of claim 6, including a vacuum source coupled with said transfer roll for drawing a vacuum within said transfer roll.

8. The multi-ply fiber web forming apparatus of claim 6, said forming fabric around said shell comprising a wire.

9. The multi-ply fiber web forming apparatus of claim 1, each of said lower forming fabric and said upper forming fabric comprising one of a wire and felt.

10. The multi-ply fiber web forming apparatus of claim 9, each of said lower forming fabric and said upper forming fabric comprising a wire.

11. A multi-ply fiber web forming apparatus, comprising:

a first forming fabric defining a first forming fabric run;

a first headbox positioned in association with said first forming fabric for discharging a fiber suspension onto said first forming fabric to form a first fiber ply;

a second forming fabric defining a second forming fabric run;

a second headbox positioned in association with said second forming fabric for discharging a fiber suspension onto said second forming fabric to form a second fiber ply;

a wet forming box positioned in association with said first forming fabric structured for applying a pressurized liquid to said first forming fabric to wet at least said first fiber ply in a transfer; and a transfer roll positioned in association with said second forming fabric, said transfer roll and said wet forming box positioned in close opposing relationship to each other whereby each of said first forming fabric and said second forming fabric pass therebetween in said transfer area.

12. The multi-ply fiber web forming apparatus of claim 11, said wet forming box including an inlet, an outlet, a weir between said inlet and said outlet, a first chamber on a side of said weir adjacent said inlet, and a second chamber on a side of said weir adjacent said outlet.

13. The multi-ply fiber web forming apparatus of claim 12, said weir extending to said first forming fabric.

14. The multi-ply fiber web forming apparatus of claim 13, said weir including a seal positioned at an end of said weir adjacent said first forming fabric.

15. The multi-ply fiber web forming apparatus of claim 12, said weir including at least one plate positioned adjacent said first forming fabric, said plate including a plurality of openings therein for allowing the liquid to pass through said plate.

16. The multi-ply fiber web forming apparatus of claim 11, said transfer roll including a shell with a plurality of openings and a forming fabric wrapped around said shell.

17. The multi-ply fiber web forming apparatus of claim 16, including a vacuum source coupled with said transfer roll for drawing a vacuum within said transfer roll.

18. The multi-ply fiber web forming apparatus of claim 16, said forming fabric around said shell comprising a wire.

19. The multi-ply fiber web forming apparatus of claim 11, each of said first forming fabric and said second forming fabric comprising one of a wire and felt.

20. The multi-ply fiber web forming apparatus of claim 19, each of said first forming fabric and said second forming fabric comprising a wire.

21. The multi-ply fiber web forming apparatus of claim 11, said first forming fabric run comprising a lower forming fabric run and said second forming fabric run comprising an upper forming fabric run, said wet forming box being positioned below said lower forming fabric and said transfer roll being positioned above said upper forming fabric in opposing relationship to said wet forming box.

22. A method of forming a multi-ply fiber web, comprising the steps of:

discharging a fiber suspension from a first headbox to form a first fiber ply carried by a lower forming fabric defining a lower forming fabric run;

discharging a fiber suspension from a second headbox to form a second fiber ply carried by an upper forming fabric defining an upper forming fabric run;

positioning a wet forming box below said lower forming fabric;

positioning a transfer roll above said upper forming fabric in close opposing relationship to said wet forming box, whereby each of said first fiber ply and said second fiber ply contact each other in a transfer area; and applying a pressurized liquid to said lower forming fabric using said wet forming box, whereby at least said first fiber ply is wetted in said transfer area.

23. The method of claim 22, wherein said applying step comprises wetting each of said first fiber ply and said second fiber ply in said transfer area.

24. The method of claim 22, wherein said applying step comprises applying water to said lower forming fabric.

25. The method of claim 22, said transfer roll having a shell with a plurality of openings, and including the further step of drawing a vacuum within said shell.

26. The method of claim 22, said wet forming box including an inlet, an outlet, and a weir separating said inlet and said outlet and extending closely adjacent said lower forming fabric, said applying step including the substep of causing said liquid to flow over said weir against said lower forming fabric.

* * * * *

UNITED STATES PATENT AND TRADEMARK OFFICE

CERTIFICATE OF CORRECTION

PATENT NO. : 6,287,420 B1
DATED : September 11, 2001
INVENTOR(S) : Edwin X. Graf It is certified that error appears in the above-identified patent and that said Letters Patent is hereby corrected as shown below:

Column 2,
Line 58, after "box" delete "IS" and insert -- 18 -- therefor.

Signed and Sealed this

Eighth Day of October, 2002

*Attest:*

*Attesting Officer*

JAMES E. ROGAN
*Director of the United States Patent and Trademark Office*